US009283142B1

(12) United States Patent
Lichti

(10) Patent No.: US 9,283,142 B1
(45) Date of Patent: Mar. 15, 2016

(54) PORTABLE SAUNA SYSTEM

(71) Applicant: Alan Lichti, Galloway, OH (US)

(72) Inventor: Alan Lichti, Galloway, OH (US)

( * ) Notice: Subject to any disclaimer, the term of this patent is extended or adjusted under 35 U.S.C. 154(b) by 354 days.

(21) Appl. No.: 13/773,369

(22) Filed: Feb. 21, 2013

(51) Int. Cl.
*A61H 33/06* (2006.01)

(52) U.S. Cl.
CPC ..... *A61H 33/06* (2013.01)

(58) Field of Classification Search
USPC ..... 4/524–534; 135/91, 92
See application file for complete search history.

(56) References Cited

U.S. PATENT DOCUMENTS

| | | | |
|---|---|---|---|
| 3,936,891 | A | 2/1976 | Kulde |
| 5,050,251 | A | 9/1991 | Pride |
| D393,934 | S | 4/1998 | Harvey |
| 6,510,565 | B1 | 1/2003 | Zwezdaryk |
| 6,745,412 | B1 | 6/2004 | Egeresi |
| D588,275 | S | 3/2009 | Lozano |
| 2005/0241058 | A1 | 11/2005 | Li |
| 2006/0207014 | A1 | 9/2006 | DeBoer et al. |
| 2007/0061958 | A1 | 3/2007 | Ye |
| 2008/0313799 | A1 | 12/2008 | Nguyen |

*Primary Examiner* — Lauren Crane

(57) ABSTRACT

The present invention features a portable sauna system having a bathtub with an enclosure on three sides. The system features a portable sauna enclosure with a U-shaped sauna anterior support, a U-shaped sauna posterior support, and a U-shaped sauna middle support. The sauna anterior support and the sauna posterior support each feature a plurality of suction cups and a foam seal disposed on the sauna anterior support anterior side and the sauna posterior support posterior side, respectively. The sauna middle support features a first rolled curtain on a first spring biased roll, and a second rolled curtain on a second spring biased roll. The sauna middle support features a plurality of suction cups and a foam seal disposed on the sauna middle support second side. The system features a heat source.

8 Claims, 6 Drawing Sheets

PORTABLE SAUNA SYSTEM

BACKGROUND OF THE INVENTION

Hot springs, and heated caves have been viewed for centuries as places to go for promoting health and relaxation of the body. Saunas were developed using this concepts as a means to bring the therapeutic benefits of heat and moisture found in these locations into daily life in a health club setting. For these who wish to partake of these benefits without venturing out of their home, the present invention features a portable sauna system using a bathtub with an enclosure on three sides.

SUMMARY

The present invention features a portable sauna system comprising a bathtub having an enclosure on three sides. In some embodiments, the system comprises a portable sauna enclosure having a U-shaped sauna anterior support, a U-shaped sauna posterior support, and a U-shaped sauna middle support.

In some embodiments, the sauna anterior support and the sauna posterior support each comprise a plurality of suction cups and a foam seal located on the sauna anterior support anterior side and the sauna posterior support posterior side, respectively. In some embodiments, the sauna middle support comprises a first roiled curtain on a first spring biased roll, and a second rolled curtain on a second spring biased roll. In some embodiments, the sauna middle support comprises a plurality of suction cups and a foam seal located on a sauna middle support third side. In some embodiments, the system comprises a heat source.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
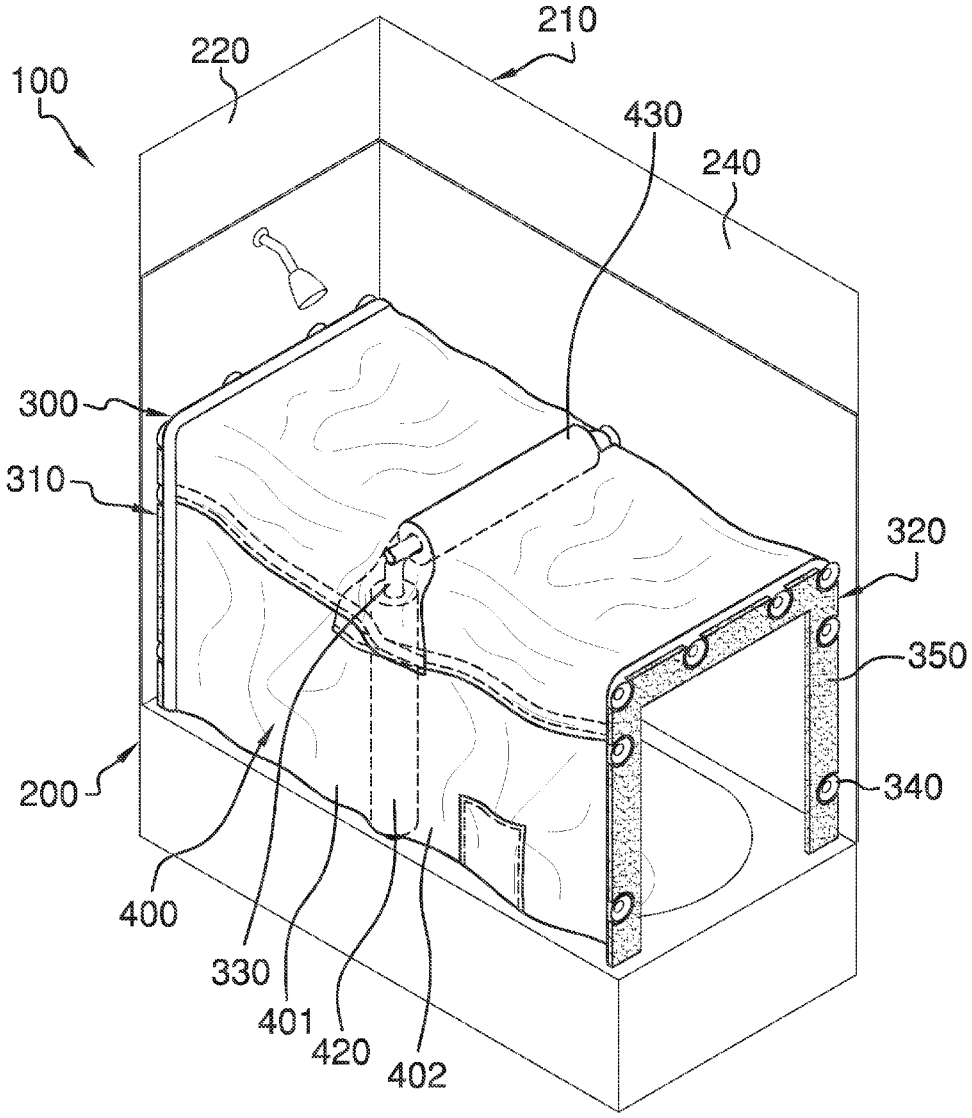
FIG. 1 is a perspective view of the present invention.
Figure 2:
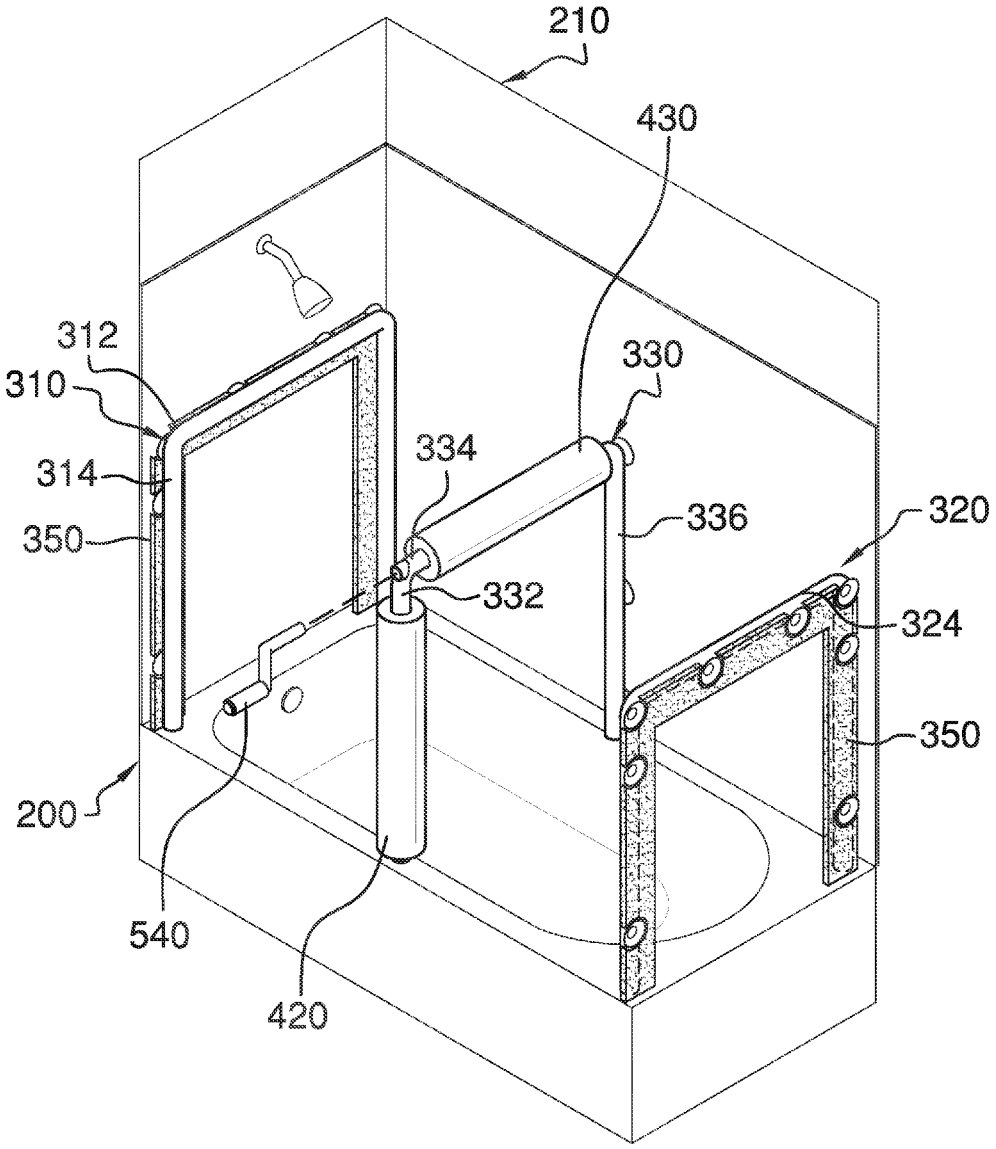
FIG. 2 is a perspective view of the sauna anterior support, the sauna posterior support and the sauna middle support of the present invention.
Figure 3:
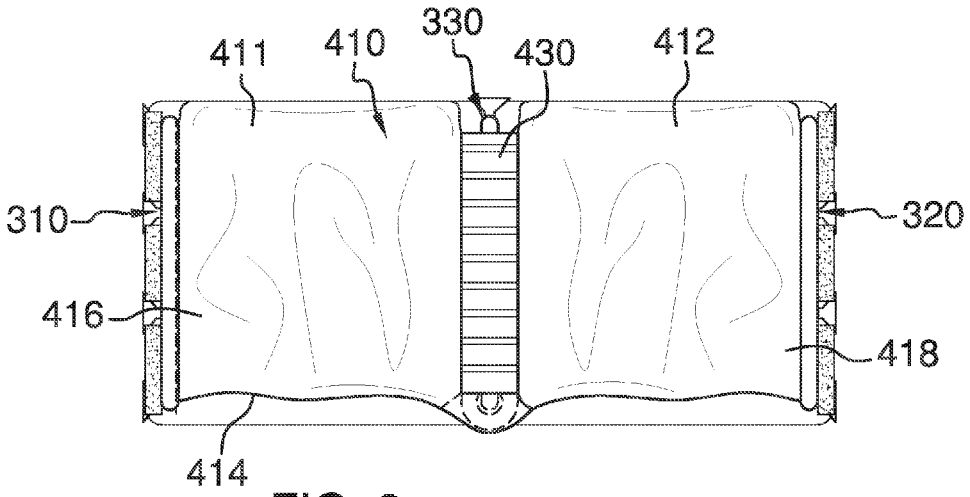
FIG. 3 is a top view of the portable sauna enclosure of the present invention.
Figure 4:
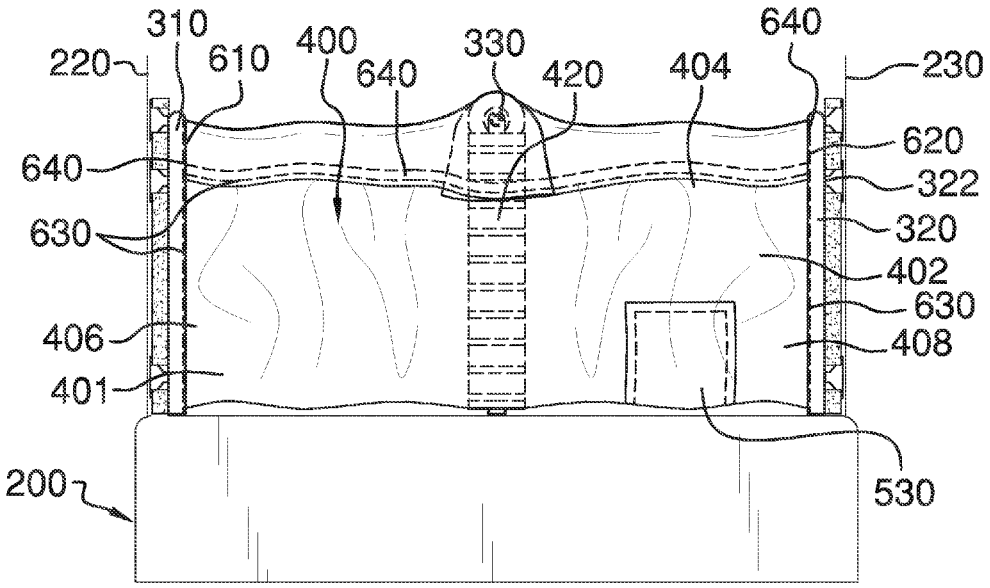
FIG. 4 is a side view of the portable sauna enclosure of the present invention.
Figure 5:
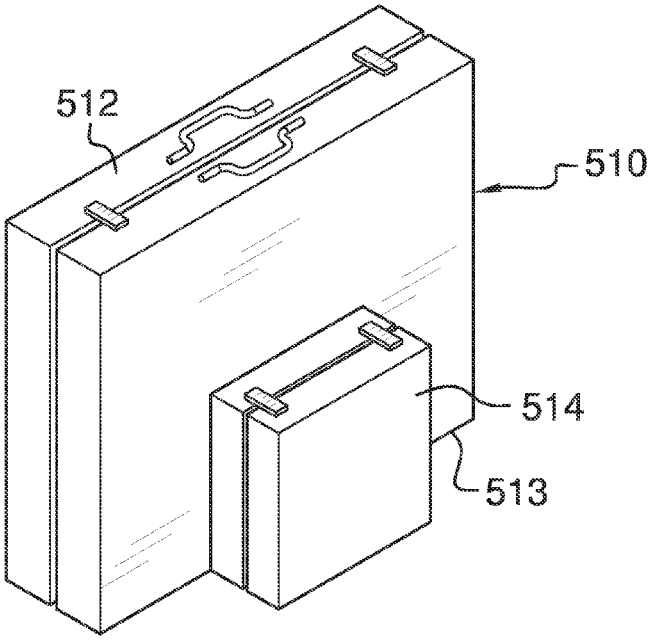
FIG. 5 is a perspective view of a carrying case of the present invention.
Figure 6:
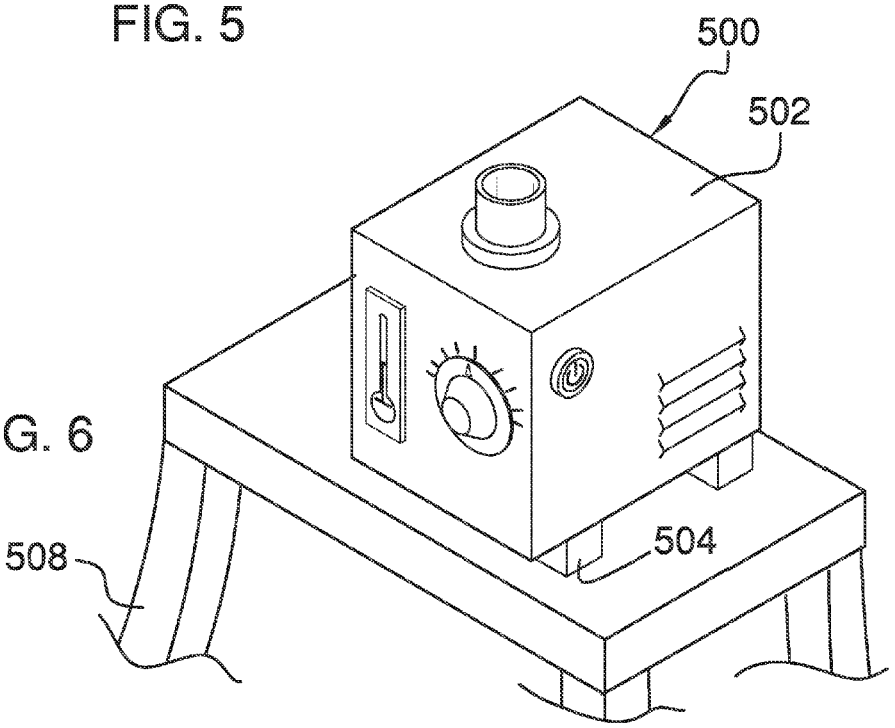
FIG. 6 is a perspective view of an alternate embodiment of the heat source of the present invention.
Figure 7:
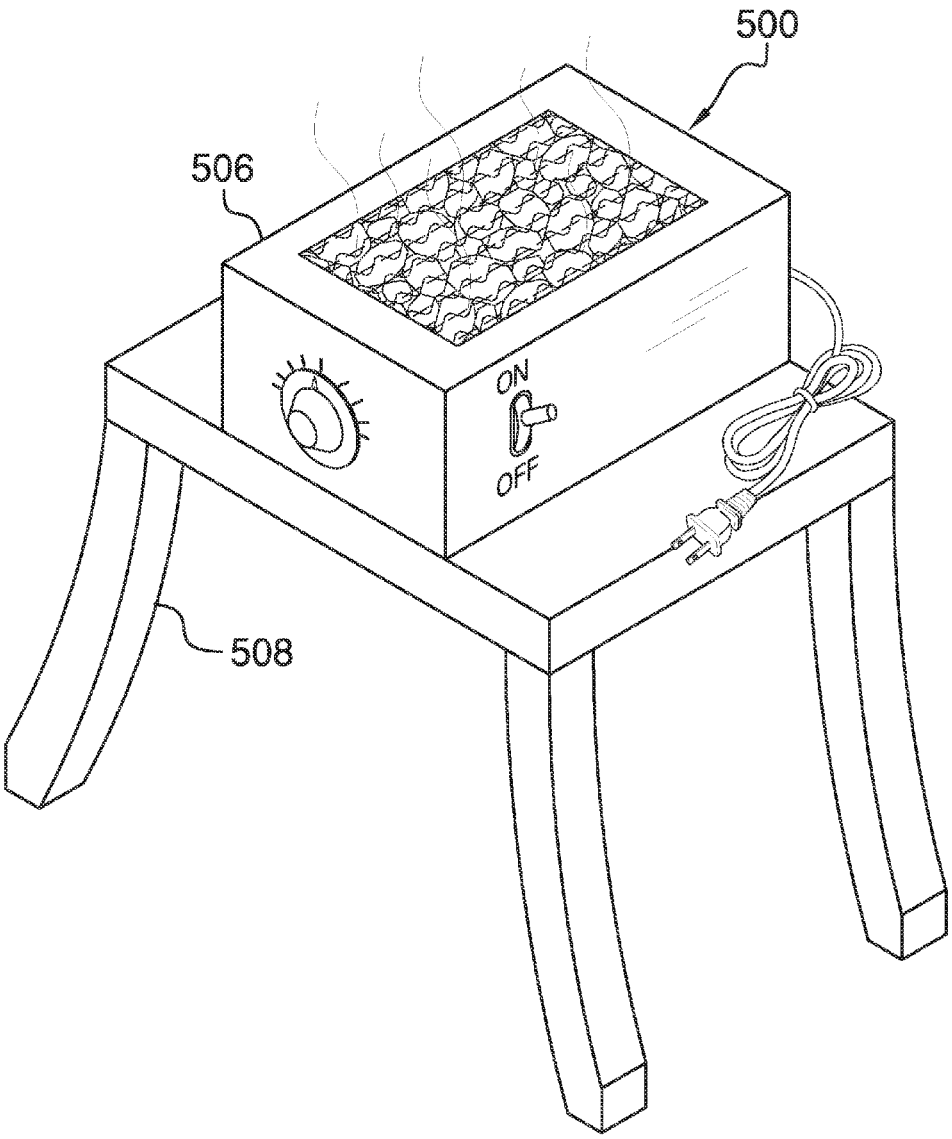
FIG. 7 is a perspective view of an alternate embodiment the heat source of the present invention featuring a stand.
Figure 8:
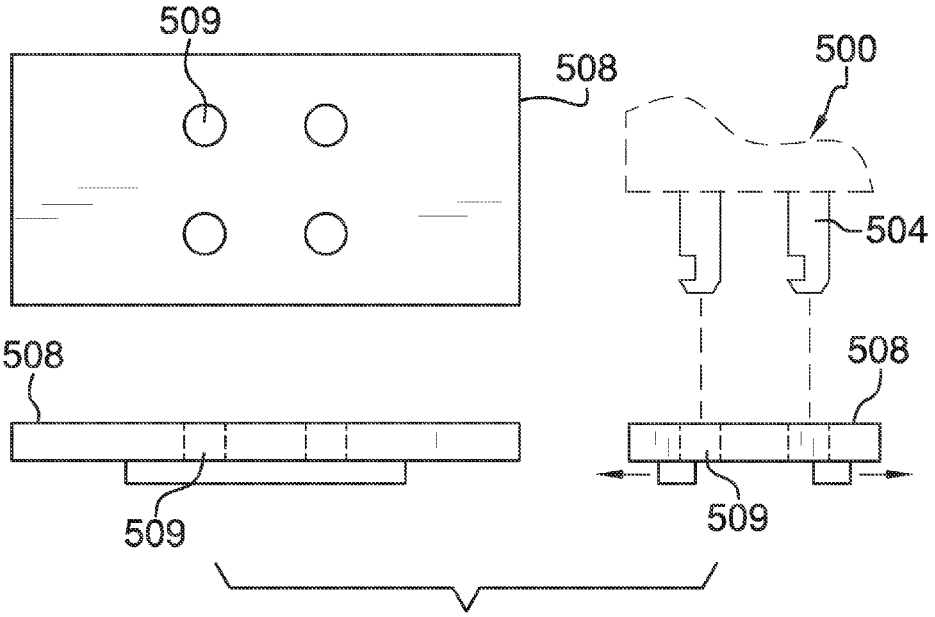
FIG. 8 is a detail view of the connection between a heat source of the present invention and a stand.
Figure 9:
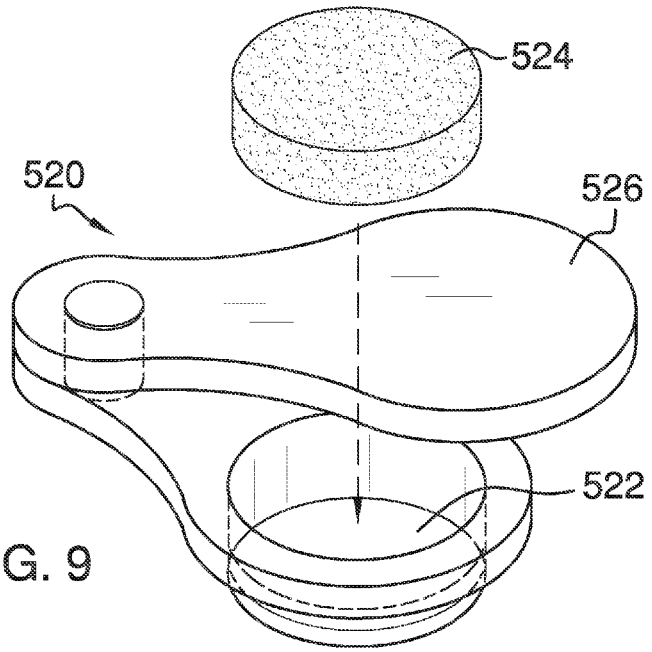
FIG. 9 is a perspective view of a scent accessory of the present invention.

Following is a list of elements corresponding to a particular element referred to herein:

100 Portable sauna system
200 Bathtub
210 Enclosure
220 Anterior enclosure wall
230 Posterior enclosure wall
240 Side enclosure wall
300 Portable sauna enclosure
310 Sauna anterior support
312 Sauna anterior support anterior side
314 Sauna anterior support exterior surface
320 Sauna posterior support
322 Sauna posterior support posterior side
324 Sauna posterior support exterior surface
330 Sauna middle support
332 Sauna middle support first side
334 Sauna middle support second side
336 Sauna middle support third side
340 Suction cup
350 Foam seal
400 First rolled curtain
401 First curtain anterior panel
402 First curtain posterior panel
404 First curtain top edge
406 First curtain anterior edge
408 First curtain posterior edge
410 Second roiled curtain
411 Second curtain anterior panel
412 Second curtain posterior panel
414 Second curtain outside edge
416 Second curtain anterior edge
418 Second curtain posterior edge
420 First spring biased roll
430 Second spring biased roll
500 Heat source
502 Humidifier
504 Leg
506 Heater
508 Stand
509 Hole
510 Carrying case
512 First compartment
513 First compartment bottom edge
514 Second compartment
520 Scent accessory
522 Pocket
524 Scent disc
526 Cover
530 Steam vent
540 Handle
610 First attachment means
620 Second attachment means
630 Third attachment means
640 Fourth attachment means Referring now to FIGS. 1-9, the present invention features a portable sauna system (100) that surrounds the entire body and head of an individual user. In some embodiments, the system (100) comprises a bathtub (200) having a surrounding enclosure (210) on three sides. In some embodiments, the surrounding enclosure (210) comprises an anterior enclosure wall (220), a posterior enclosure wall (230), and a side enclosure wall (240).

In some embodiments, the system (100) comprises a portable sauna enclosure (300) having a U-shaped sauna anterior support (310), a U-shaped sauna posterior support (320), and a U-shaped sauna middle support (330). In some embodiments, the sauna anterior support (310) comprises a plurality of suction cups (340) located on a sauna anterior support anterior side (312). In some embodiments, the sauna anterior support (310) comprises a first foam seal (350) located on the sauna anterior support anterior side (312). In some embodiments, the sauna anterior support (310) comprises a first attachment means (610) located on a sauna anterior support exterior surface (314). In some embodiments, the sauna anterior support (310) is located on the anterior enclosure wall (220) via the suction cups (340) and the first foam seal (360) located thereon.

In some embodiments, the sauna posterior support (320) comprises a plurality of suction cups (340) located on a sauna posterior support posterior side (322). In some embodiments, the sauna posterior support (320) comprises a second foam seal (350) located on the sauna posterior support posterior side (322). In some embodiments, the sauna posterior support (320) comprises a second attachment means (620) located on a sauna posterior support exterior surface (324). In some embodiments, the sauna posterior support (320) is located on the posterior enclosure wall (230) via the suction cups (340) and the second foam seal (350) located thereon.

In some embodiments, the sauna middle support (330) comprises a first rolled curtain (400) having a first curtain anterior panel (401) and a first curtain posterior panel (402) located on a sauna middle support first side (332) In some embodiments, the first rolled curtain (400) is located on a first spring biased roll (420). In some embodiments, the sauna middle support (330) comprises a second rolled curtain (410) having a second curtain anterior panel (411) and a second curtain posterior panel (412) located on the sauna middle support second side (334). In some embodiments, the second rolled curtain (410) is located on a second spring biased roll (430). In some embodiments, the sauna middle support (330) comprises a plurality of suction cups (340) located on a sauna middle support third side (336). In some embodiments, the sauna middle support (330) comprises a third foam seal (350) located on the sauna middle support third side (336). In some embodiments, the sauna middle support (330) is located on the side enclosure wall (240) via the suction cups (340) and the third foam seal (350).

In some embodiments, the first rolled curtain (400) comprises a third attachment means (630) located on a first curtain top edge (404), a first curtain anterior edge (406), and a first curtain posterior edge (408) thereon. In some embodiments, the second rolled curtain (410) comprises a fourth attachment means (640) located on a second curtain outside edge (414), a second curtain anterior edge (416), and a second curtain anterior edge (418) thereon.

In some embodiments, the first rolled curtain (400) is extended from the first spring biased roll (420). In some embodiments, the first rolled curtain (400) is attached to the sauna anterior support (310) via connecting the third attachment means (630) to the first attachment means (610). In some embodiments, the first rolled curtain (400) is attached to the sauna posterior support (320) via connecting the third attachment means (630) to the second attachment means (620).

In some embodiments, the second rolled curtain (410) is extended from the second spring biased roil (430). In some embodiments, the second rolled curtain (410) is attached to the sauna anterior support (310) via connecting the fourth attachment means (640) to the first attachment means (610). In some embodiments, the second rolled curtain (410) is attached to the sauna posterior support (320) via connecting the fourth attachment means (640) to the second attachment means (620). In some embodiments, the first rolled curtain (400) is attached to the second rolled curtain (410) via connecting the third attachment means to the fourth attachment means.

In some embodiments, the system (100) comprises a heat source (500) located inside the portable sauna enclosure (300). In some embodiments, the heat source (500) provides heat to the portable sauna enclosure (300) for a user. In some embodiments, the heat source (500) provides a wet heat (steam), In some embodiments, the heat source (500) provides a dry heat (air). In some embodiments, the heat source (500) is operatively connected to a power source.

In some embodiments, the system (100) comprises a carrying case (510). In some embodiments, the carrying case (510) comprises a first compartment (512) and a second compartment (514) centrally located on the first compartment (512) close to a first compartment bottom edge (513). In some embodiments, the first compartment (512) is adapted to receive the portable sauna enclosure (300) for storage. In some embodiments, the second compartment (514) is adapted to receive the heat source (500) for storage.

In some embodiments, the heat source (500) comprises a humidifier(502). In some embodiments, the humidifier (502) comprises projecting legs (504). In some embodiments, the humidifier (502) comprises temperature control.

In some embodiments, the heat source (500) comprises a heater (506). In some embodiments, the heater (506) comprises projecting legs (504). In some embodiments, the heater (506) comprises temperature control.

In some embodiments, the system (100) comprises a stand (508) for securely mounting a heat source (500). In some embodiments, the stand (508) comprises a plurality of holes (509) located on a to surface thereon. In some embodiments, the plurality of holes (509) is adapted to latchably receive one or more projecting legs (504) located on the heat source (500). In some embodiments, the stand (508) comprises a folding leg. In some embodiments, the stand (508) is adapted to straddle the bathtub (200).

In some embodiments, the system (100) comprises a scent accessory (520) threadably attached to the humidifier (502). In some embodiments, the scent accessory (520) comprises a pocket (522) adapted to receive a scent disc (524). In some embodiments, the pocket (522) comprises a cover (526) pivotally located. thereon.

In some embodiments, the first curtain posterior panel (402) comprises a sealable steam vent (530) for allowing ambient air in to the enclosure as desired by the user.

In some embodiments, the first spring biased roll (420) comprises a removable handle (540) for extending or retracting the first rolled curtain (400).

In some embodiments, the second spring biased roll (430) comprises a removable handle (540) for extending or retracting the second rolled curtain (410).

As used herein, the term "about" refers to plus or minus 10% of the referenced number. For example an embodiment wherein the first rolled curtain is about 10 inches in length includes a first rolled curtain that is between 9 and 11 inches in length.

The disclosures of the following U.S. Patents are incorporated in their entirety by reference herein: U.S. Pat. Nos. 3,936,891; 5,050,251; 6,510,565; 6,745,412; U.S. Patent Pub. Nos. 2005/0241058; 2006/0207014; 2007/0061958; 2008/0313799; U.S. Pat. Nos. D 393,934; D 588,275.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may he made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A portable sauna system (100) that covers the entire body and head of an individual user, said system (100) comprising:

(a) a bathtub (200) having a surrounding enclosure (210) on three sides, wherein the surrounding enclosure (210) comprises an anterior enclosure wall (220), a posterior enclosure wall (230), and a side enclosure wall (240);

(b) a portable sauna enclosure (300) having a U-shaped sauna anterior support (310), a U-shaped sauna posterior support (320), and a U-shaped sauna middle support (330), wherein the sauna anterior support (310) comprises a plurality of suction cups (340) disposed on a sauna anterior support anterior side (312), wherein the sauna anterior support (310) comprises a first foam seal (350) disposed on the sauna anterior support anterior side (312), wherein the sauna anterior support (310) comprises a first attachment means (610) disposed on a sauna anterior support exterior surface (314), wherein the sauna anterior support (310) is disposed on the anterior enclosure wall (220) via the suction cups (340) and the first foam seal (350) disposed thereon, wherein the sauna posterior support (320) comprises a plurality of suction cups (340) disposed on a sauna posterior support posterior side (322), wherein the sauna posterior support (320) comprises a second foam seal (350) disposed on the sauna posterior support posterior side (322), wherein the sauna posterior support (320) comprises a second attachment means (620) disposed a sauna posterior support exterior surface (324), wherein the sauna posterior support (320) is disposed on the posterior enclosure wall (230) via the suction cups (340) and the second foam seal (350) disposed thereon, wherein the sauna middle support (330) comprises a first rolled curtain (400) having a first curtain anterior panel (401) and a first curtain posterior panel (402) disposed on a sauna middle support first side (332), wherein the first rolled curtain (400) is disposed on a first spring biased roll (420), wherein the sauna middle support (330) comprises a second rolled curtain (410) having a second curtain anterior panel (411) and a second curtain posterior panel (412) disposed on the sauna middle support second side (334), wherein the second rolled curtain (410) is disposed on a second spring biased roll (430), wherein the sauna middle support (330) comprises a plurality of suction cups (340) disposed on a sauna middle support third side (336), wherein the sauna middle support (330) is disposed on the side enclosure wall (240) via the suction cups (340), wherein the first rolled curtain (400) comprises a third attachment means (630) disposed on a first curtain top edge (404), a first curtain anterior edge (406), and a first curtain posterior edge (408) thereon, wherein the second rolled curtain (410) comprises a fourth attachment means (640) disposed on a second curtain outside edge (414), a second curtain anterior edge (416), and a second curtain posterior edge (418) thereon, wherein the first rolled curtain (400) is extended from the first spring biased roll (420), wherein the first rolled curtain (400) is disposed on the sauna anterior support (310) via connecting the third attachment means (630) to the first attachment means (610), wherein the first rolled curtain (400) is disposed on the sauna posterior support (320) via connecting the third attachment means (630) to the second attachment means (620), wherein the second rolled curtain (410) is extended from the second spring biased roll (430), wherein the second rolled curtain (410) is disposed on the sauna anterior support (310) via connecting the fourth attachment means (640) to the first attachment means (610), wherein the second rolled curtain (410) is disposed on the sauna posterior support (320) via connecting the fourth attachment means (640) to the second attachment means (620), wherein the first rolled curtain (400) is disposed on the second rolled curtain (410) via connecting the third attachment means (630) to the fourth attachment means (640); and (c) a heat source (500) disposed inside the portable sauna enclosure (300), wherein the heat source (500) provides heat to the portable sauna enclosure (300) for a user.

2. The system (100) of claim 1, wherein the system (100) comprises a carrying case (510), wherein the carrying case (510) comprises a first compartment (512) and a second compartment (514) centrally disposed on the first compartment (512) proximal to a first compartment bottom edge (513), wherein the first compartment (512) is adapted to receive the portable sauna enclosure (300) for storage, wherein the second compartment (514) is adapted to receive the heat source (500) for storage.

3. The system (100) of claim 1, wherein the heat source (500) comprises a humidifier (502), wherein the humidifier (502) comprises projecting legs (504), wherein the humidifier (502) comprises temperature control.

4. The system (100) of claim 1, wherein the system (100) comprises a stand (508) for securely mounting the heat source (500), wherein the stand (508) comprises a plurality of holes (509) disposed on a top surface thereon, wherein the plurality of holes (509) is adapted to latchably receive one or more projecting legs (504) disposed on the heat source (500), wherein the stand (508) comprises a folding stand leg, wherein the stand (508) is adapted to straddle the bathtub (200).

5. The system (100) of claim 3, wherein the system (100) comprises a scent accessory (520) threadably attached to the humidifier (502), wherein the scent accessory (520) comprises a pocket (522) adapted to receive a scent disc (524), wherein the pocket (522) comprises a cover (526) pivotally disposed thereon.

6. The system (100) of claim 1, wherein the first curtain posterior panel (402) comprises a sealable steam vent (530).

7. The system (100) of claim 1, wherein the first spring biased roll (420) comprises a removable handle (540) for extending or retracting the first rolled curtain (400).

8. The system (100) of claim 1, wherein the second spring biased roll (430) comprises a removable handle (540) for extending or retracting the second rolled curtain (410).

* * * * *